US005510143A

United States Patent [19]

Walsh et al.

[11] Patent Number: 5,510,143

[45] Date of Patent: Apr. 23, 1996

[54] METHOD AND APPARATUS FOR IMPRESSING A PATTERN ON FLOCKED MATERIALS

[75] Inventors: David I. Walsh, No. Providence, R.I.; William F. Laird, Kingston, Canada

[73] Assignee: Microfibres, Inc., Pawtucket, R.I.

[21] Appl. No.: 277,702

[22] Filed: Jul. 20, 1994

Related U.S. Application Data

[63] Continuation of Ser. No. 994,447, Dec. 23, 1992, abandoned, which is a continuation of Ser. No. 698,379, May 9, 1991, abandoned, which is a continuation of Ser. No. 403,764, Sep. 6, 1989, abandoned.

[51] Int. Cl.[6] ..... B05D 1/14

[52] U.S. Cl. ..... 427/206; 156/72; 219/121.6; 219/121.69; 427/366

[58] Field of Search ..... 427/180, 200, 427/206, 365, 372.2, 385.5, 366, 346; 118/68, 102, 308; 156/72, 209, 279, 298, 324, 390, 435, 443, 547, 552; 219/121.6, 212.67, 121.68, 121.69, 121.85; 26/2 R

[56] References Cited

U.S. PATENT DOCUMENTS

| | | | |
|---|---|---|---|
| 3,170,974 | 2/1965 | Jacobs | 264/284 |
| 3,275,487 | 9/1966 | Lemelson | 156/72 |
| 3,832,948 | 9/1974 | Barker | 219/121.69 |
| 3,916,823 | 11/1975 | Halloran | 118/63 |
| 3,917,883 | 11/1975 | Jepson | 156/435 |
| 4,015,221 | 3/1977 | Dalton | 219/121.6 |
| 4,211,743 | 7/1980 | Nauta et al. | 264/284 |
| 4,271,111 | 6/1981 | Sheber | 264/226 |
| 4,668,323 | 5/1987 | Lenards et al. | 156/279 |
| 4,836,874 | 6/1989 | Foster | 264/284 |
| 5,061,232 | 10/1991 | Bloch et al. | 242/55.53 |
| 5,126,531 | 6/1992 | Majima et al. | 219/121.68 |

FOREIGN PATENT DOCUMENTS

| | | | |
|---|---|---|---|
| 0492000 | 4/1953 | Canada | 427/200 |
| 2542367 | 4/1976 | Germany | 427/200 |
| 0156825 | 9/1982 | Germany | 427/200 |
| 1399821 | 7/1975 | United Kingdom . | |

*Primary Examiner*—Steven D. Maki
*Attorney, Agent, or Firm*—Cesari and McKenna

[57] ABSTRACT

A pattern is impressed on flocked fabric by applying a patterned cylinder to the flocked surface before the adhesive that retains the flocking has cured. The projections on the cylinder surface tilt the flock fibers contacted by them to a new orientation, thereby forming the pattern in the flocked surface. Subsequent curing of the adhesive preserves the pattern.

1 Claim, 1 Drawing Sheet

METHOD AND APPARATUS FOR IMPRESSING A PATTERN ON FLOCKED MATERIALS

This application is a continuation of U.S. patent application Ser. No. 07/994,447 filed Dec. 23, 1992, which is a continuation of U.S. patent application Ser. No. 07/698,379 filed May 9, 1991, which is a continuation of U.S. patent application Ser. No. 07/403,764 filed Sep. 6, 1989, all of which prior applications have been abandoned.

FIELD OF THE INVENTION

This invention relates to the impression of decorative patterns in flocked materials. More specifically, it relates to the use of a patterned cylinder to impress a pattern in flocked fibers by forcing the fibers in the pattern to assume a different orientation from the fibers in the background area.

BACKGROUND OF THE INVENTION

The process to which this invention relates should be distinguished from those processes in which flocking is selectively applied to a substrate to form pattern. In those cases the pattern is usually applied to the substrate in the form of an adhesive and the flocking is then applied to the substrate, where it selectively adheres to the adhesive pattern.

With the inventive process, on the other hand, the flocking is adhered to the entire substrate or an area thereof, with the fibers being given a uniform orientation by means of an electric field, for example. The desired pattern is then impressed by tilting selected portions of the flocking away from that orientation. These portions are visually distinguished from the background patterns by the difference in the orientation of the flocked fibers.

In one prior system for impressing a pattern in flocked material, the material is passed through a nip on one side of which is a heated metallic cylinder whose surface has been embossed with the desired pattern. The raised portions of the cylinder surface heat the flocking fibers contacted by them, thereby, raising the temperature of the fibers above their softening point. Simultaneously, the raised portions bend the fibers over into a new orientation. The fibers are frozen into this orientation upon subsequent cooling and thereby retain the impressed pattern.

The main drawbacks of this prior system are the cost of constructing and operating the heated cylinder, the extended time required to form the cylinder and the need for running the system at elevated temperatures, typically up to 400° F., thereby requiring complex equipment to apply the heat, presenting safety problems and sometimes causing undesired physical changes in the fabric. Moreover, since the fibers in the pattern portions are bent, they are non-linear, that is, their orientations vary from their tips down to the surface of the adhesive layer in which they are retained and their appearance is thereby affected in a manner which may be undesirable.

In another prior system the pattern is impressed on the fibers before the binding adhesive has set or cured. Again the flocked material is passed beneath a cylinder. This time, the cylinder is provided with apertures corresponding to the desired pattern. A cylindrical brush fills the interior of the cylinder and the bristles of this brush extend into the apertures, essentially flush with the external surface of the cylinder. The cylinder rotates with the moving material at the same speed as the material, while the brush rotates within the cylinder in the same direction but at a considerably higher speed. As a result, the fibers contacted by the cylinder surface are tilted in a direction opposite the direction of movement of the material, while those contacted by the brush are tilted in the direction of material movement, thereby forming the desired pattern. Subsequent curing of the adhesive retains the fibers in their differentially tilted orientations. This arrangement has the advantage of superior appearance since the fibers are linear, i.e., they have the same orientations throughout their lengths. However, proper operation of the system requires the use of a very thin cylinder, which is difficult to manufacture and also is difficult to support so as to maintain its desired cylindrical shape. Moreover, with this system it is difficult to impress patterns having fine detail.

Another prior system operating on the fibers before the adhesive has set employs an apertured cylinder. Air jets passing through the apertures tilt the fibers on which they impinge, thus forming the desired pattern. This system too provides a superior appearance to the fibers which are thereby tilted rather than bent. However, it is incapable of providing patterns with sharp edges and fine detail.

SUMMARY OF THE INVENTION

A pattern impression system incorporating the present invention uses a cylinder whose surface is configured with raised portions corresponding to the desired pattern. However, in contra-distinction to the prior embossed cylinders, this "patterned cylinder" engages the flocked material before the flock-retaining adhesive has set. The cylinder is unheated and its contact with the flocking fibers tilts them, thus imparting a more desirable appearance to the pattern. Moreover, the patterned cylinder is less expensive to construct and operate than the prior heated cylinders.

The system is also less expensive to construct than the prior apertured-cylinder systems and furthermore it provides pattern definition which is superior to that of those systems.

More specifically, because the cylinder is not heated, its surface need not be metallic. It can be a resinous material and thus can be inexpensively configured with the desired pattern by means of laser milling. Furthermore, the pattern can quickly be entered into a computer which controls a laser beam that is directed against the cylinder surface for the milling process. Thus there is a fast "turn-around" between the design of a pattern and the production of a cylinder for imparting the pattern to flocked material.

The fabrication of metallic cylinder, on the other hand, is substantially more expensive. For example, the manufacture of an embossed cylinder involves the use of patterned knurling rollers or even direct milling of the cylinder. In either case the cylinder is much more expensive than the nonmetallic cylinder we prefer to use with our invention. Also the turn-around time for the production of a cylinder having the pattern is substantially longer.

DETAILED DESCRIPTION OF ILLUSTRATIVE EMBODIMENTS

Figure 1:
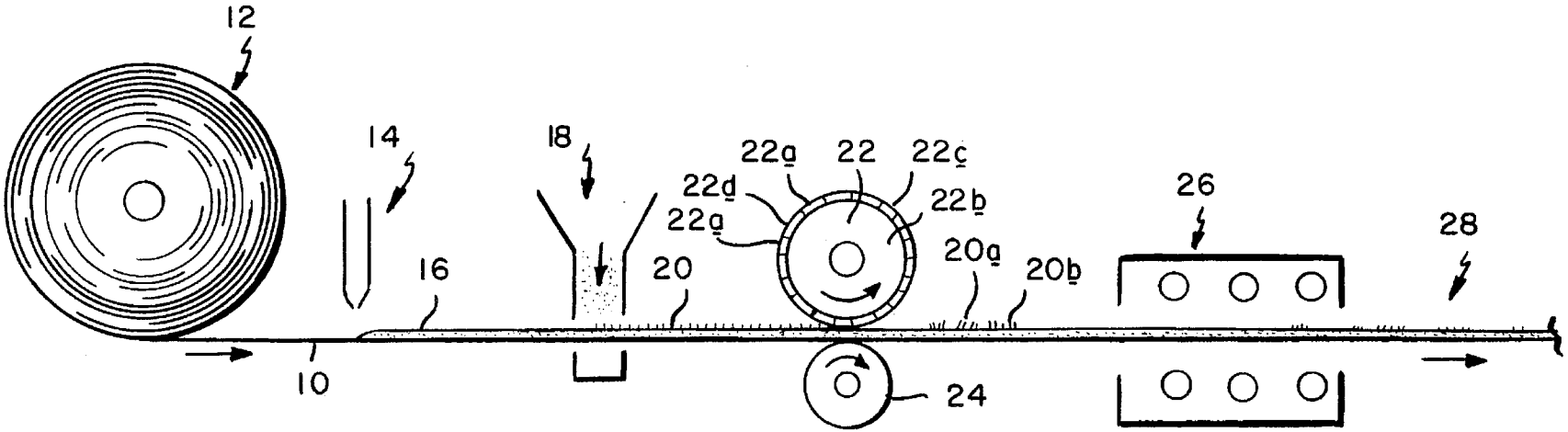
FIG. 1 is a schematic diagram of a pattern impression system embodying the invention; and, FIG. 2 is a fragmentary section of flocked material impressed with a pattern by the system of FIG. 1.

As shown in FIG. 1, a substrate 10, served from supply reel 12, passes first through an adhesive applier 14 which applies to the substrate a coating 16 of adhesive suitable for the retention of flocking fibers. The coated substrate then passes through a flocking chamber 18 where flocking fibers are applied to adhesive coating 16 by any well known means suitable for imparting a uniform orientation to the fibers. This orientation can be perpendicular to the substrate. However, we prefer to orient the fibers somewhat away from the perpendicular, e.g. 15°, to help avoid "crush marks" when the fabric is used.

Figure 2:
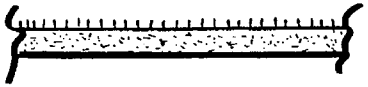

The substrate 10, now carrying a layer 20 of flocking fibers, next passes through the nip between a cylinder 22 and a back-up cylinder 24. The cylinder 22 is configured with a raised pattern that is to be applied to the flocked material and the raised portions 22*a* of the cylinder surface thus engage the flock layer 20, thereby tilting the fibers contacted by those portions to a new orientation. The degree to which the fibers are tilted depends on the spacing between the cylinder 22 and cylinder 24, as well as the thickness of the composite material passing through the nip. Typically, the system is adjusted to tilt these fibers to an orientation 65° from the perpendicular. In any case, the cylinder 22 need not contact the adhesive layer 16. The tilted fibers, shown at 20*a* in FIGS. 1 and 2, are visually distinguishable from the fibers 20*b*, which have not been contacted by raised portions of the cylinder 22 and thus retain their near-vertical orientation.

After leaving the patterned cylinder 22, the flocked material, now impressed with the desired pattern, passes through a curing chamber 26 that cures the adhesive in the layer 16. This permanently retains the flocking fibers and in particular retains them in their orientations imparted to them in the flocking chamber 18 and by the cylinder 22. Finally the finished material passes to a take-up reel (not shown).

The patterned cylinder 22 preferably comprises a steel core 22*b* covered with a skin 22*c* of a suitable resinous material. The skin may be formed with a smooth surface and then engraved by means of a laser beam to form the raised portions 22*a*. For example, the core 22*b* may be helically wrapped with a strip of ethylene-propylene rubber, which is then vulcanized, followed by grinding to provide the desired finish.

The depressions 22*d*, i.e. the areas from which material is removed by the engraving process, have a depth that depends on the lengths of the flocking fibers: the larger the fibers, the greater will be the depths of the depressions, so as not to tilt the fibers whose orientations are not to be changed by the cylinder 22. The thickness of the skin 22*c* should be sufficient to accommodate the depths of the depressions 22*d*.

Preferably a suitable release material is incorporated into the material of the skin 22*c* or applied to the skin after engraving. This largely prevents clogging of the skin by picking up flocking fibers and associated adhesive during operation of the system.

As an example of the method described herein, a substrate 10 of material having a thickness of 0.008 inch was coated with a 0.012 inch adhesive layer 16 of a water-based acrylic latex having a solids content of 42% by weight. The material, moving at a speed of 45 feet/minute, received nylon flocking fibers having a nominal length of 0.080 inch and an orientation of 15° from the perpendicular. The patterned cylinder had a peripheral speed of 45 feet/minute. The raised portions of the cylinder surface had a height of 0.70 inch above the bottoms of the depressions 22*d* and the nip beneath the cylinder had a height of 0.035 inch. The adhesive was dried and cured by hot air convection in a multiple zone oven (chamber 26), the temperature having been set to 250° F. in the first zone for drying and 305° F. in the second zone for curing.

The foregoing description has been limited to a specific embodiment of this invention. It will be apparent, however, that variations and modifications may be made to the invention, with the attainment of some or all of the advantages of the invention. Therefore, it is the object of the appended claims to cover all such variations and modifications as come within the true spirit and scope of the invention.

What is claimed is:

1. A method for preparing a flocked product having tilted fibers which form a pattern, said method comprising the steps of:

A. preparing a cylinder with a resinous outer surface and forming projections and depressions by laser milling said surface;

B. applying to a surface of a substrate a water based adhesive;

C. applying flocking fibers to said adhesive with a substantially uniform first orientation of said fibers to form a flocked substrate;

D. passing said flocked substrate through a nip between said cylinder and a backup cylinder, engaging fibers of said flocked substrate with the projections of said cylinder such that the cylinder having said projections does not contact the adhesive and tilting the fibers engaged by said projections to an orientation different from said first orientation to provide the flocked substrate with tilted fibers which form a pattern; and E. drying and setting said adhesive.

* * * * *